US007919936B2

(12) United States Patent
Liu et al.

(10) Patent No.: US 7,919,936 B2
(45) Date of Patent: Apr. 5, 2011

(54) DRIVING CIRCUIT FOR POWERING LIGHT SOURCES

(75) Inventors: Da Liu, Milpitas, CA (US); Yung-Lin Lin, Palo Alto, CA (US)

(73) Assignee: O2 Micro, Inc, Santa Clara, CA (US)

( * ) Notice: Subject to any disclaimer, the term of this patent is extended or adjusted under 35 U.S.C. 154(b) by 431 days.

(21) Appl. No.: 12/221,648

(22) Filed: Aug. 5, 2008

(65) Prior Publication Data

US 2010/0033109 A1 Feb. 11, 2010

(51) Int. Cl.
*H05B 37/02* (2006.01)

(52) U.S. Cl. ..... 315/307; 315/185 R; 315/192

(58) Field of Classification Search ..... 315/291, 315/307, 308, 185 R, 191, 192, 227 R, 240, 315/241 R, 242
See application file for complete search history.

(56) References Cited

U.S. PATENT DOCUMENTS

| | | | | |
|---|---|---|---|---|
| 6,724,156 | B2 * | 4/2004 | Fregoso | 315/291 |
| 7,402,961 | B2 * | 7/2008 | Bayat et al. | 315/295 |
| 7,710,047 | B2 * | 5/2010 | Shteynberg et al. | 315/291 |
| 7,777,430 | B2 * | 8/2010 | Catalano et al. | 315/309 |

* cited by examiner

*Primary Examiner* — David Hung Vu

(57) ABSTRACT

There is provided a driving circuit for powering a plurality of light sources. The driving circuit includes a power converter, a plurality of switching regulators and a plurality of switching balance controllers. The power converter is operable for receiving an input voltage and for providing a regulated voltage to the light sources. The switching regulators are operable for adjusting forward voltages of the light sources respectively. The switching balance controllers are operable for generating pulse modulation signals to control the switching regulators respectively.

20 Claims, 10 Drawing Sheets

DRIVING CIRCUIT FOR POWERING LIGHT SOURCES

TECHNICAL FIELD

Embodiments in accordance with the present invention relates to driving circuits for driving light sources.

BACKGROUND ART

In a display system, one or more light sources are driven by a driving circuit for illuminating a display panel. For example, in a liquid crystal display (LCD) display system with light emitting diode (LED) backlight, an LED array is used for illuminating an LCD panel. An LED array usually comprises two or more LED strings, and each LED string comprises a group of LEDs connected in series. For each LED string, the forward voltage required to achieve a desired light output can vary with LED die sizes, LED die material, LED die lot variations, and temperature. Therefore, in order to generate desired light outputs with a uniform brightness, the forward voltage of each LED string should be adjusted such that the LED current flowing through each LED string is substantially the same. There are two traditional methods as shown in FIG. 1 and FIG. 2.

FIG. 1 shows a block diagram of a conventional LED driving circuit 100. The LED driving circuit 100 includes a DC/DC converter 102 for converting an input DC voltage Vin to a desired output DC voltage Vout for powering LED strings 108_1, 108_2, . . . 108_n. Each of the LED strings 108_1, 108_2, . . . 108_n is respectively coupled to a linear LED current regulator 106_1, 106_2, . . . 106_n in series. A selection circuit 104 receives monitoring signals from current sensing resistors Rsen_1, Rsen_2, . . . Rsen_n and generates a feedback signal. The DC/DC converter 102 adjusts the output DC voltage Vout based on the feedback signal. Operational amplifiers 110_1, 110_2, . . . 110_n in the linear LED current regulators compare a reference signal REF and the monitoring signals from current sensing resistors Rsen_1, Rsen_2, . . . Rsen_n respectively, and generate control signals to adjust the resistance of transistors Q1, Q2, . . . Qn respectively in a linear mode. In other words, the conventional LED driving circuit 100 controls transistors Q1, Q2, . . . Qn linearly to adjust the LED currents flowing through the LED strings 108_1, 108_2, . . . 108_n respectively. However, this solution may not be suitable for systems requiring relatively large LED current, which may result in a larger amount of heat generated by the transistors Q1, Q2, . . . Qn. As such, the power efficiency of the system may be decreased due to the heat/power dissipation.

FIG. 2 shows a block diagram of another conventional LED driving circuit 200. In FIG. 2, each LED string is coupled to a dedicated DC/DC converter 202_1, 202_2, . . . 202_n respectively. Each DC/DC converter 202_1, 202_2, . . . 202_n receives a feedback signal from a corresponding current sensing resistor Rsen_1, Rsen_2, . . . Rsen_n and adjusts an output voltage Vout_1, Vout_2, . . . Vout_n respectively according to a corresponding LED current demand. One of the drawbacks of this solution is that the system cost can be increased if there are a large number of LED strings, since a dedicated DC/DC converter is required for each LED string.

SUMMARY

According to one embodiment of the invention, a driving circuit for powering a plurality of light sources includes a power converter, a plurality of switching regulators and a plurality of switching balance controllers. The power converter is operable for receiving an input voltage and for providing a regulated voltage to the light sources. The switching regulators are operable for adjusting forward voltages of the light sources respectively. The switching balance controllers are operable for generating pulse modulation signals to control the switching regulators respectively.

BRIEF DESCRIPTION OF THE DRAWINGS

Features and advantages of embodiments of the invention will become apparent as the following detailed description proceeds, and upon reference to the drawings, where like numerals depict like elements, and in which.

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention. In the exemplary embodiments of the present invention, LED strings are used as examples of light sources for illustration purposes. However, the driving circuits disclosed in the present invention can be used to drive various light sources which are not limited to LED strings.

Figure 1:
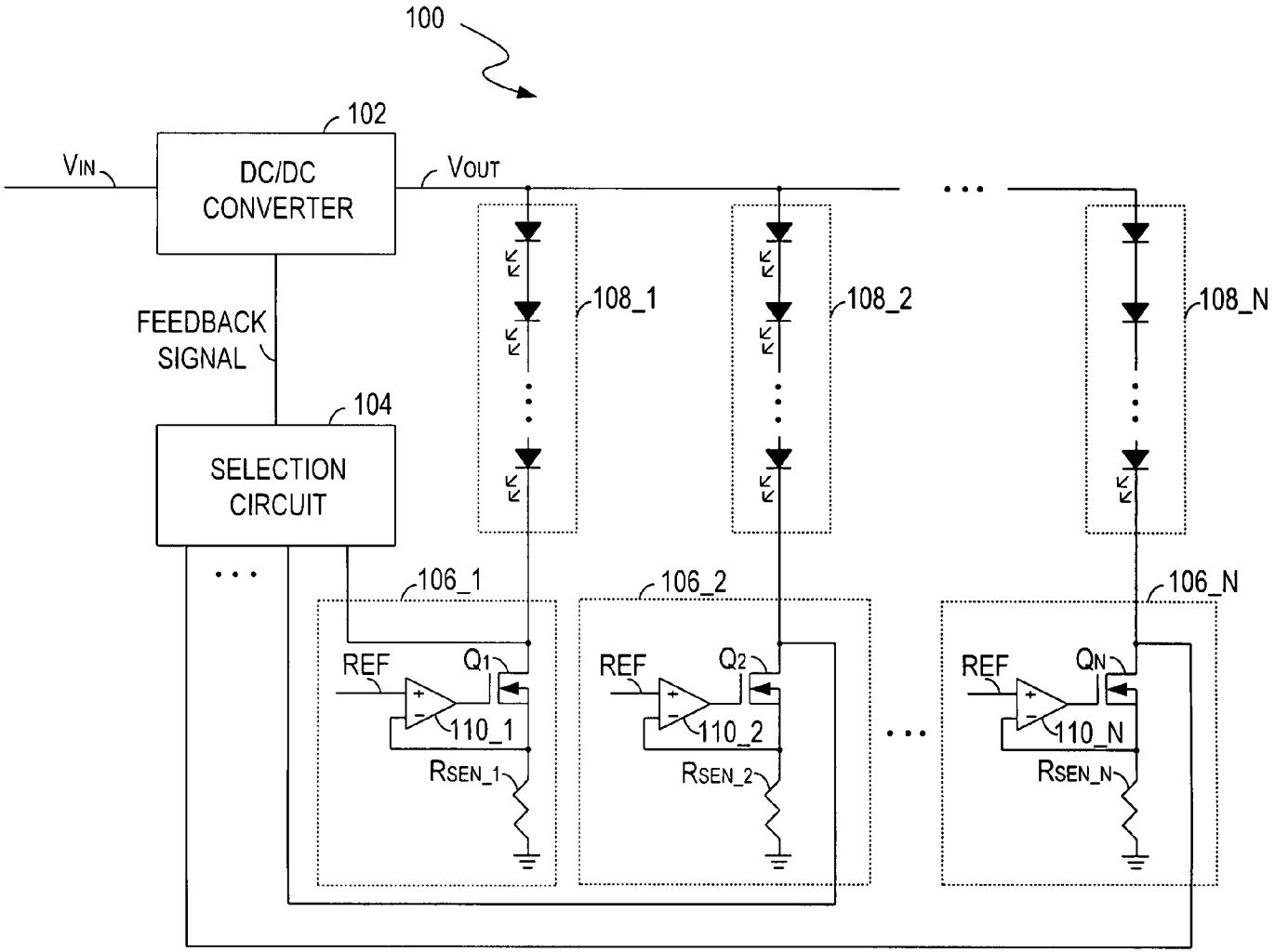
FIG. 1 PRIOR ART
FIG. 1 shows a schematic diagram of a conventional LED driving circuit.
Figure 2:
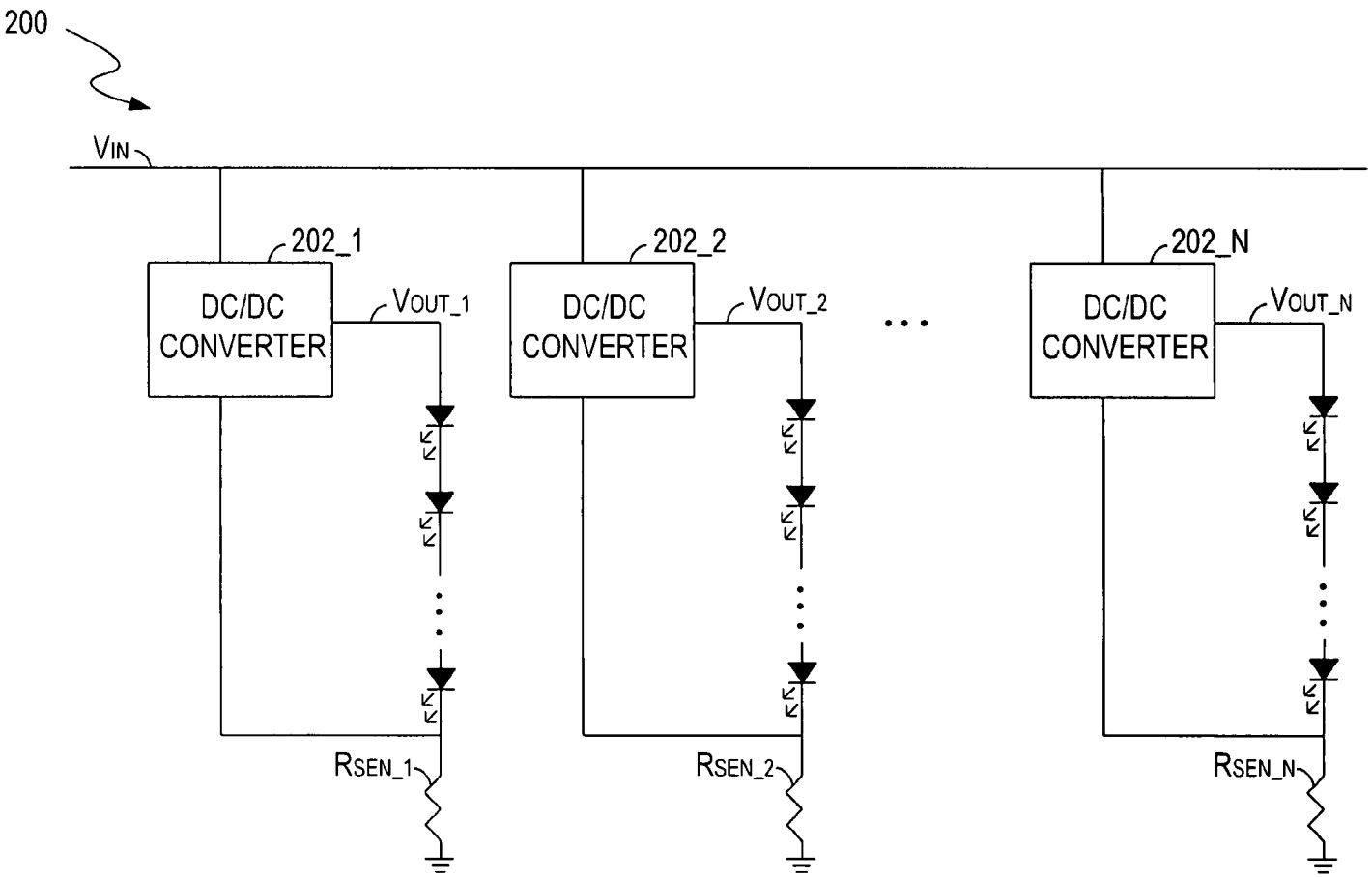
FIG. 2 PRIOR ART
FIG. 2 shows a schematic diagram of another conventional LED driving circuit.
Figure 3:
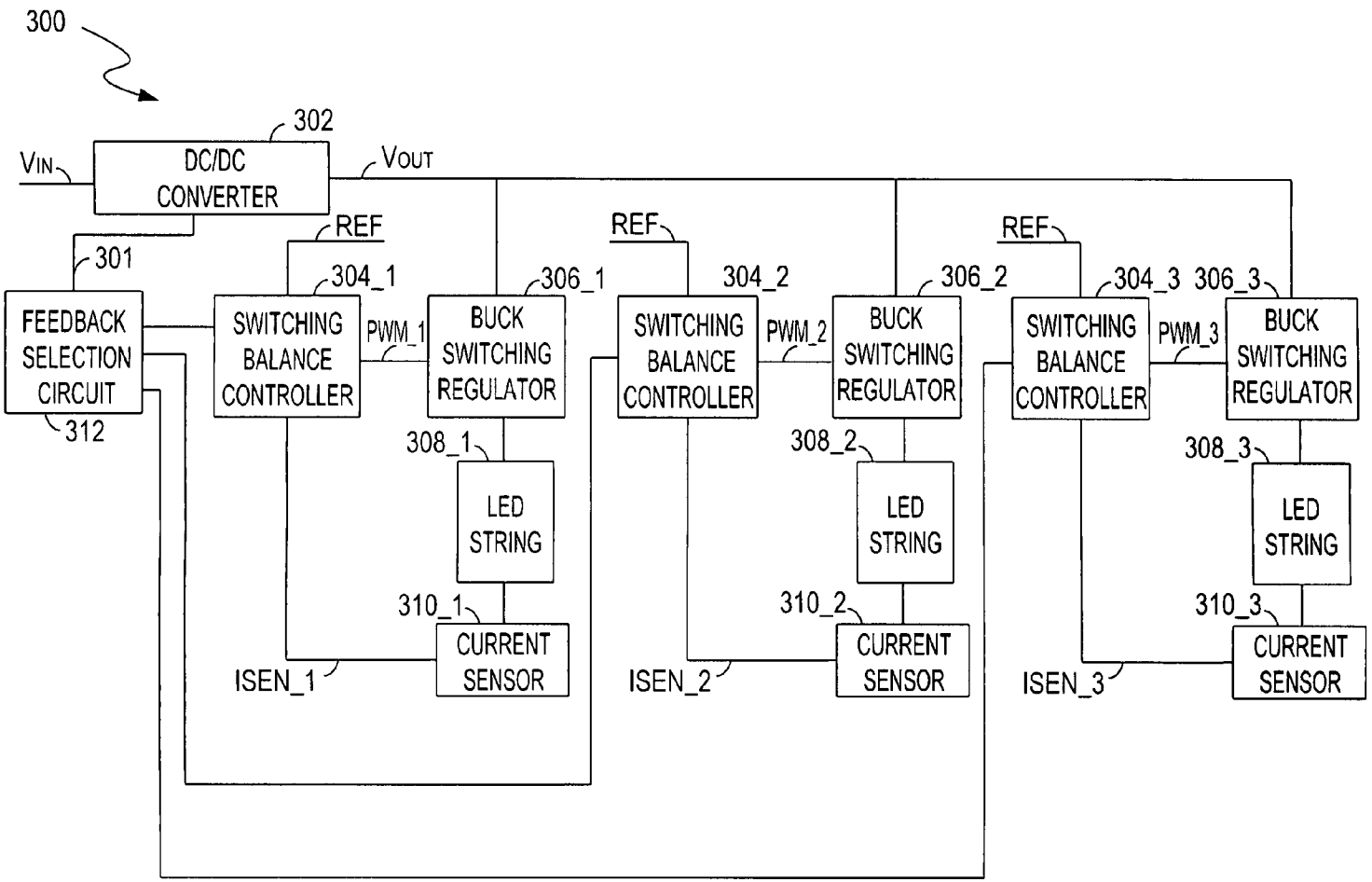
FIG. 3 shows a block diagram of an LED driving circuit, in accordance with one embodiment of the present invention.

FIG. 3 shows a block diagram of an LED driving circuit 300, in accordance with one embodiment of the present invention. The LED driving circuit 300 includes a power converter (e.g., a DC/DC converter 302) for providing a regulated voltage to a plurality of LED strings. In the example of FIG. 3, there are three LED strings 308_1, 308_2, and 308_3. However, any number of the LED strings can be included in the LED driving circuit 300. The LED driving circuit 300 also includes a plurality of switching regulators (e.g., a plurality of buck switching regulators) 306_1, 306_2, and 306_3 coupled to the DC/DC converter 302 for adjusting forward voltages of the LED strings 308_1, 308_2, and 308_3 respectively. The LED driving circuit 300 also includes a plurality of switching balance controller 304_1, 304_2 and 304_3 for controlling the buck switching regulators 306_1, 306_2, and 306_3 respectively. A feedback selection circuit 312 can be coupled between the DC/DC converter 302 and the buck switching regulators 306_1, 306_2, 306_3 for adjusting the output voltage of DC/DC converter 302. A plurality of current sensors 310_1, 310_2 and 310_3 are coupled to LED strings 308_1, 308_2, and 308_3 respectively for providing a plurality of monitoring signals ISEN_1, ISEN_2 and ISEN_3 which indicate LED currents flowing through the LED strings 308_1, 308_2, and 308_3 respectively, in one embodiment.

In operation, the DC/DC converter 302 receives an input voltage Vin and provides a regulated voltage Vout. Each of the switching balance controllers 304_1, 304_2 and 304_3 receives the same reference signal REF indicating a target current flowing through each LED string 308_1, 308_2, and 308_3, and receives a corresponding monitoring signal ISEN_1, ISEN_2, ISEN_3 from a corresponding current sensor, in one embodiment. Switching balance controllers 304_1, 304_2 and 304_3 generate pulse modulation signals (e.g., pulse width modulation signals) PWM_1, PWM_2, PWM_3 respectively according to the reference signal REF and a corresponding monitoring signal, and adjust voltage drops across buck switching regulators 306_1, 306_2, and 306_3 with the pulse modulation signals PWM_1, PWM_2, PWM_3 respectively, in one embodiment.

The buck switching regulators 306_1, 306_2, and 306_3 are controlled by switching balance controllers 304_1, 304_2 and 304_3 respectively to adjust voltage drops across buck switching regulators 306_1, 306_2, and 306_3. For each of the LED strings 308_1, 308_2, and 308_3, an LED current flows through the LED string according to a forward voltage of the LED string (the voltage drop across the LED string). The forward voltage of the LED string can be proportional to a difference between the regulated voltage Vout and a voltage drop across a corresponding switching regulator. As such, by adjusting the voltage drops across switching regulators 306_1, 306_2, and 306_3 with the switching balance controller 304_1, 304_2 and 304_3 respectively, the forward voltages of the LED strings 308_1, 308_2, and 308_3 can be adjusted accordingly. Therefore, the LED currents of the LED strings 308_1, 308_2, and 308_3 can also be adjusted accordingly. In one embodiment of the invention, the switching balance controllers 304_1, 304_2 and 304_3 adjust the voltage drops across switching regulators 306_1, 306_2, and 306_3 respectively such that all the LED currents are substantially the same as the target current. Here the term "substantially the same" in the present disclosure means that the LED currents can vary but within a range such that all of the LED strings can generate desired light outputs with a relatively uniform brightness.

The switching balance controllers 304_1, 304_2 and 304_3 are also capable of generating a plurality of error signals according to the monitoring signals ISEN_1, ISEN_2, ISEN_3 and the reference signal REF. Each of the error signals can indicate a forward voltage required by a corresponding LED string to produce an LED current which is substantially the same as the target current. The feedback selection circuit 312 can receive the error signals and determine which LED string has a maximum forward voltage. For each of the LED strings 308_1, 308_2, and 308_3, the corresponding forward voltage required to achieve a desired light output can be different. The term "maximum forward voltage" used in the present disclosure indicates the largest forward voltage among the forward voltages of LED strings 308_1, 308_2, and 308_3 when LED strings 308_1, 308_2, and 308_3 can generate desired light outputs with a relatively uniform brightness, in one embodiment. The feedback selection circuit 312 generates a feedback signal 301 indicating the LED current of the LED string having the maximum forward voltage. Consequently, the DC/DC converter 302 adjusts the regulated voltage Vout according to the feedback signal 301 to satisfy a power need of the LED string having the maximum forward voltage, in one embodiment. For example, the DCIDC converter 302 increases Vout to increase the LED current of the LED string having the maximum forward voltage, or decreases Vout to decrease the LED current of the LED string having the maximum forward voltage.

Figure 4:
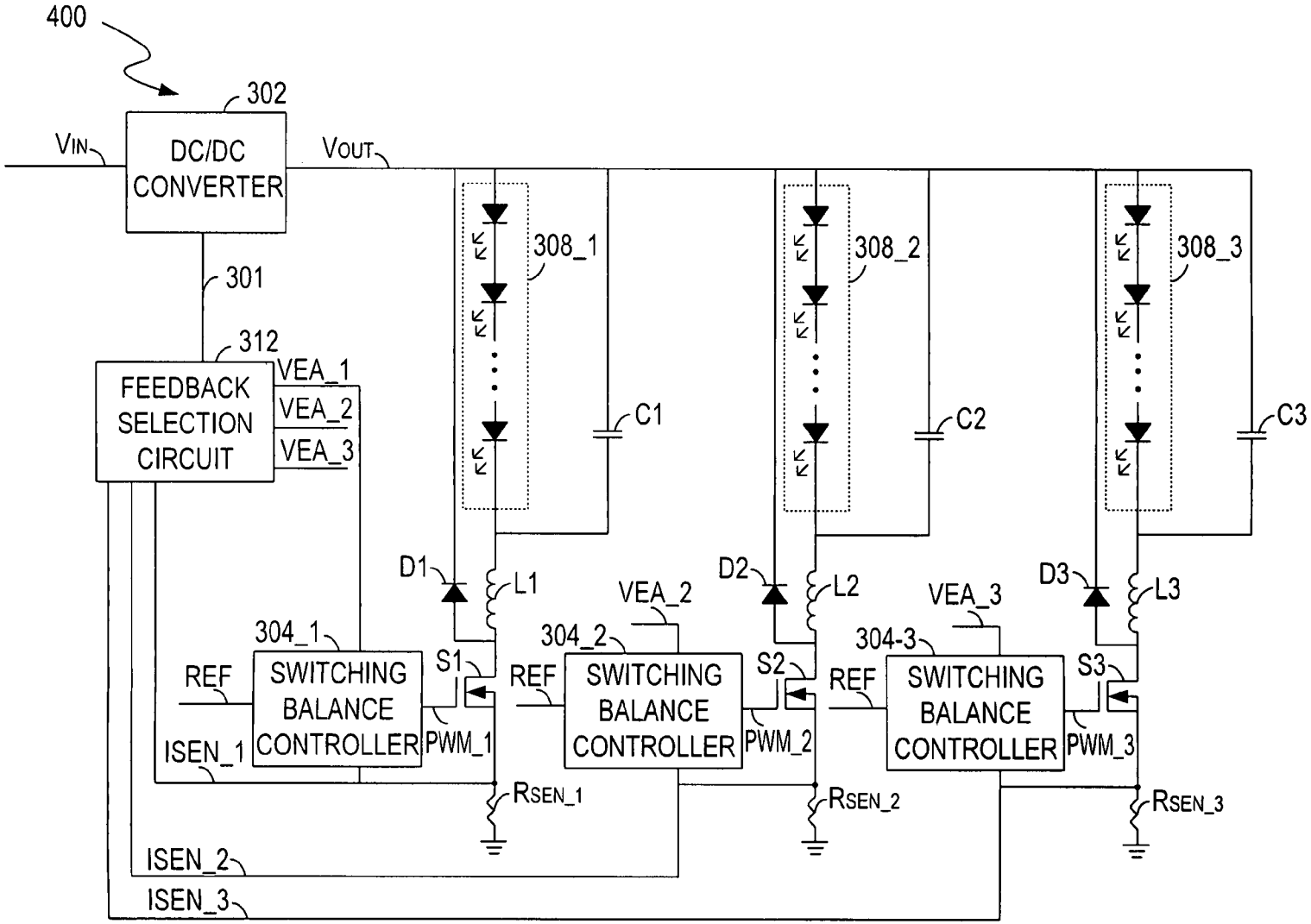
FIG. 4 shows a schematic diagram of an LED driving circuit, in accordance with one embodiment of the present invention.

FIG. 4 shows a schematic diagram of an LED driving circuit 400 with a common anode connection, in accordance with one embodiment of the present invention. FIG. 4 is described in combination with FIG. 3. Elements labeled the same as in FIG. 3 have similar functions and will not be detailed described herein. In the example of FIG. 4, there are three LED strings 308_1, 308_2, and 308_3. However, any number of the LED strings can be included in the LED driving circuit 400.

The LED driving circuit 400 utilizes a plurality of switching regulators (e.g., buck switching regulators) to adjust forward voltages of LED strings 308_1, 308_2, 308_3 based on a reference signal REF and a plurality of monitoring signals ISEN_1, ISEN_2, ISEN_3 which indicate LED currents of the LED strings 308_1, 308_2, 308_3 respectively. The monitoring signals ISEN_1, ISEN_2, ISEN_3 can be obtained from a plurality of current sensors. In the example of FIG. 4, each current sensor includes a current sensing resistor Rsen_i (i=1, 2, 3).

In one embodiment, each buck switching regulator includes a inductor Li(i=1, 2, 3), a diode Di (i=1, 2, 3), a capacitor Ci (i=1, 2, 3) and a switch Si (i=1, 2, 3). The inductor Li is coupled in series with a corresponding LED string 308_i (i=1, 2, 3). The diode Di is coupled in parallel with the serially connected LED string 308_i and the inductor Li. The capacitor Ci is coupled in parallel with a corresponding LED string 308_i. The switch Si is coupled between a corresponding inductor Li and ground. Each buck switching regulator is controlled by a pulse modulation signal, e.g., a pulse width modulation (PWM) signal PWM_i (i=1, 2, 3), generated by a corresponding switching balance controller 304_i (i=1, 2, 3).

The LED driving circuit 400 also includes a DCIDC converter 302 for providing a regulated voltage, and a feedback selection circuit 312 for providing a feedback signal 301 to adjust the regulated voltage of the DC/DC converter, in order to satisfy a power need of an LED string having a maximum forward voltage.

In operation, the DC/DC converter 302 receives an input voltage Vin and provides a regulated voltage Vout. The switching balance controller 304_i controls the conductance status of a corresponding switch Si with a PWM signal PWM_i (i=1, 2, 3).

During a first time period when the switch Si is turned on, an LED current flows through the LED string 308_i, the inductor Li, the switch Si, and the current sensing resistor Rsen_i to ground. The forward voltage of the LED string 308_i is proportional to a difference between the regulated voltage Vout and a voltage drop across a corresponding switching regulator, in one embodiment. During this first time period, DC/DC converter 302 powers the LED string 308_i and charges the inductor Li simultaneously by the regulated voltage Vout. During a second time period when the switch Si is turned off, an LED current flows through the LED string 308_i, the inductor Li and the diode Di. During this second time period, the inductor Li discharges to power the LED string 308_i.

In order to control the conductance status of the switch Si, the switching balance controller 304_i generates a corresponding PWM signal PWM_i having a duty cycle D. The inductor Li, the diode Di, the capacitor Ci and the switch Si constitute a buck switching regulator, in one embodiment. Neglecting the voltage drop across the switch Si and the voltage drop across the current sensing resistor Rsen_i, the forward voltage of the LED string 308_i is equal to Vout*D, in one embodiment. Therefore, by adjusting the duty cycle D of the PWM signal PWM_i, the forward voltage of a corresponding LED string 308_i can be adjusted accordingly.

The switching balance controller 304_i receives a reference signal REF indicating a target current and receives a monitoring signal ISEN_i (i=1, 2, 3) indicating an LED current of the LED string 308_i, and compares the reference signal REF and the monitoring signal ISEN_i to adjust the duty cycle D of the PWM signal PWM_i accordingly so as to make the LED current substantially the same with the target current, in one embodiment. More specifically, the switching balance controller 304_i generates an error signal VEA_i (i=1, 2, 3) based on the reference signal REF and the monitoring signal ISEN_i. The error signal VEA_i can indicate the amount of the forward voltage required by a corresponding LED string 308_i to produce an LED current which is substantially the same as the target current. In one embodiment, a larger VEA_i indicates that the corresponding LED string 308_i needs a larger forward voltage. The switching balance controller 304_i in FIG. 4 is discussed in detail in relation to FIG. 5.

In one embodiment, the feedback selection circuit 312 receives the error signals VEA_i respectively from the switching balance controllers 304_i, and determines which LED string has a maximum forward voltage when all the LED currents are substantially the same. The feedback selection circuit 312 can also receive monitoring signals ISEN_i from current sensing resistors Rsen_i.

The feedback selection circuit 312 generates a feedback signal 301 indicating an LED current of the LED string having the maximum forward voltage according to the error signals VEA_i and/or the monitoring signals ISEN_i. The DC/DC converter 302 adjusts the regulated voltage Vout according to the feedback signal 301 to satisfy a power need of the LED string having the maximum forward voltage. As long as Vout can satisfy the power need of the LED string having the maximum forward voltage, Vout can also satisfy the power needs of any other LED string, in one embodiment. Therefore, all the LED strings can be supplied with enough power to generate desired light outputs with a relatively uniform brightness.

Figure 5:
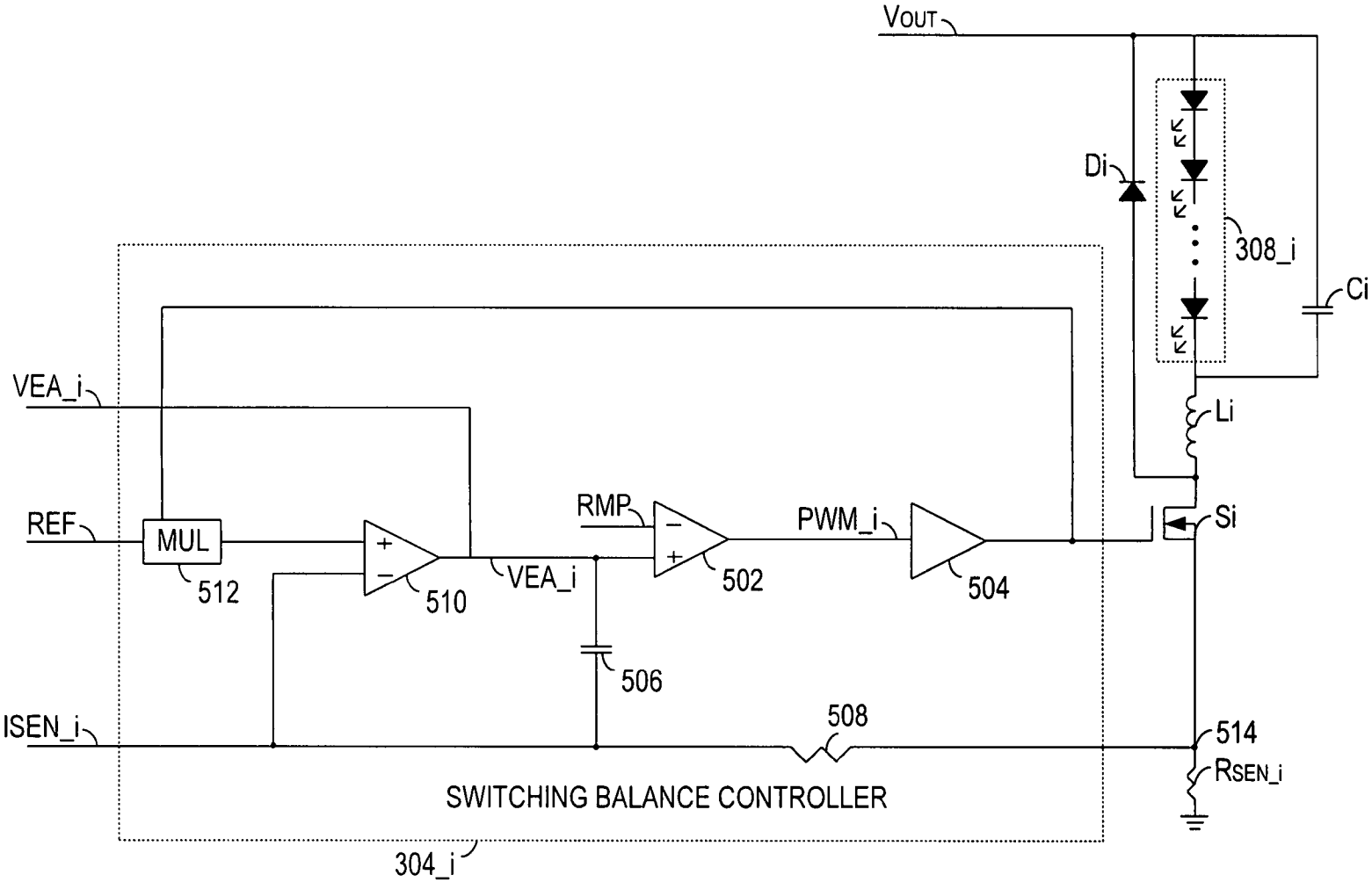
FIG. 5 shows an exemplary structure of a switching balance controller shown in FIG. 4 and the connection between the switching balance controller and a corresponding LED string, in accordance with one embodiment of the present invention.

FIG. 5 illustrates an exemplary structure of a switching balance controller 304_i shown in FIG. 4 and the connection between the switching balance controller 304_i and a corresponding LED string 308_i. FIG. 5 is described in combination with FIG. 4.

In the example of FIG. 5, the switching balance controller 304_i includes an integrator for generating the error signal VEA_i, and a comparator 502 for comparing the error signal VEA_i with a ramp signal RMP to generate the PWM signal PWM_i. The integrator is shown as a resistor 508 coupled to the current sensing resistor Rsen_i, an error amplifier 510, a capacitor 506 with one end coupled between the error amplifier 510 and the comparator 502 while the other end coupled to the resistor 508, in one embodiment.

The error amplifier 510 receives two inputs. The first input is a product of the reference signal REF multiplied with the PWM signal PWM_i by a multiplier 512. The second input is the monitoring signal ISEN_i from the current sensing resistor Rsen_i. The output of the error amplifier 510 is the error signal VEA_i.

At the comparator 502, the error signal VEA_i is compared with the ramp signal RMP to generate the PWM signal PWM_i and to adjust the duty cycle of the PWM signal PWM_i. The PWM signal PWM_i is passed through a buffer 504 and is used to control the conductance status of a switch Si in a corresponding buck switching regulator. During a first time period when the error signal VEA_i is higher than the ramp signal RMP, the PWM signal PWM_i is set to digital 1 and the switch Si is turned on, in one embodiment. During a second time period when the error signal VEA_i is lower than the ramp signal RMP, the PWM signal PWM_i is set to digital 0 and the switch Si is turned off, in one embodiment.

As such, by comparing the error signal VEA_i with the ramp signal RMP, the duty cycle D of the PWM signal PWM_i can be adjusted accordingly. In one embodiment, the duty cycle D of the PWM signal PWM_i increases when the level of error signal VEA_i increases and the duty cycle D of the PWM signal PWM_i decreases when the level of error signal VEA_i decreases. At the same time, the forward voltage of the LED string is adjusted accordingly by the PWM signal PWM_i. In one embodiment, a PWM signal with a larger duty cycle results in a larger forward voltage across the LED string 308_i and a PWM signal with a smaller duty cycle results in a smaller forward voltage across the LED string 308_i.

In one embodiment, the feedback selection circuit 312 shown in FIG. 4 receives VEA_1, VEA_2 VEA_3 and determines which LED string has a maximum forward voltage by comparing VEA_1, VEA_2 and VEA_3. For example, if VEA_1<VEA_2<VEA_3, the feedback selection circuit 312 determines that LED string 308_3 has the maximum forward voltage, and generates a feedback signal 301 indicating the LED current of LED string 308_3. The DC/DC converter 302 shown in FIG. 4 receives the feedback signal 301 and adjusts the regulated voltage Vout accordingly to satisfy a power need of LED string 308_3. As long as Vout can satisfy the power need of LED string 308_3, it can also satisfy the power needs of LED string 308_1 and LED string 308_2. Therefore, all the LED strings 308_1, 308_2 and 308_3 can be supplied with enough power to generate desired light outputs with a relatively uniform brightness.

Figure 6:
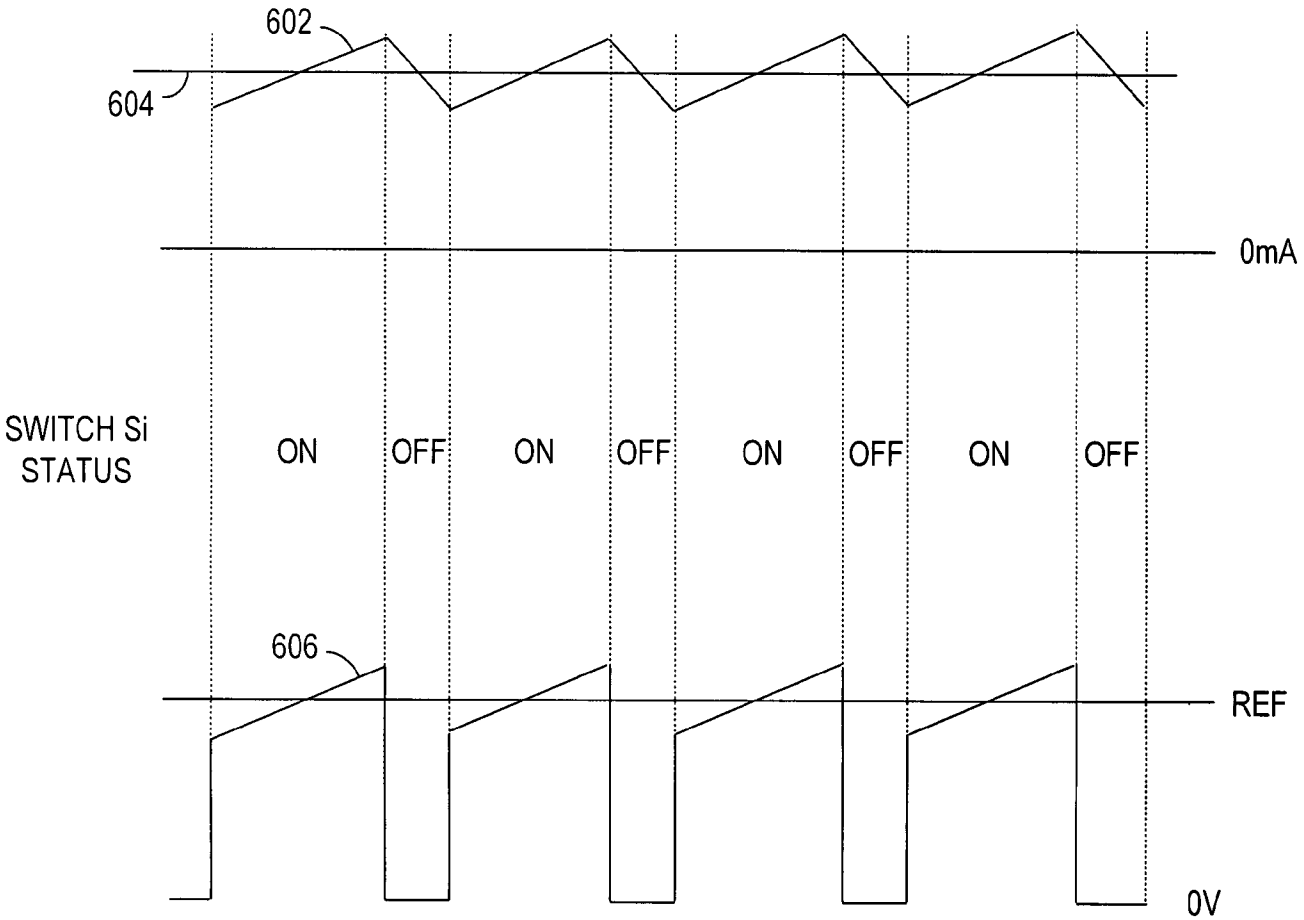
FIG. 6 illustrates the relationship among an LED current, an inductor current, and a voltage waveform at the current sensing resistor shown in FIG. 5, in accordance with one embodiment of the present invention.

FIG. 6 illustrates an exemplary relationship among an LED current 604 of LED string 308_i, an inductor current 602 of inductor Li, and a voltage waveform 606 at node 514 between Rsen_i and switch Si. FIG. 6 is described in combination with FIG. 4 and FIG. 5.

During the time period when the switch Si is turned on, the DC/DC converter 302 powers the LED string 308_i and charges the inductor Li by the regulated voltage Vout. When the switch Si is turned on by PWM_i, the inductor current 602 flows through the switch Si and current sensing resistor Rsen_i to ground. The inductor current 602 increases when the switch Si is on, and the voltage waveform 606 at node 514 increases simultaneously.

During the time period when the switch Si is turned off, the inductor Li discharges and the LED string 308_i is powered by the inductor Li. When the switch Si is turned off by PWM_i, the inductor current 602 flows through the inductor Li, the diode Di and the LED string 308_i. The inductor current 602 decreases when the switch Si is off. Since there is no current flowing through the current sensing resistor Rsen_i, the voltage waveform 606 at node 514 decreases to 0.

In one embodiment, the capacitor Ci coupled in parallel with the LED string 308_i filters the inductor current 602 and yields a substantially constant LED current 604 whose level is an average level of the inductor current 602.

Accordingly, the LED current 604 of the LED string 308_i can be adjusted towards the target current. The average voltage at node 514 when the switch Si is turned on is equal to the voltage of the reference signal REF, in one embodiment.

Figure 7:
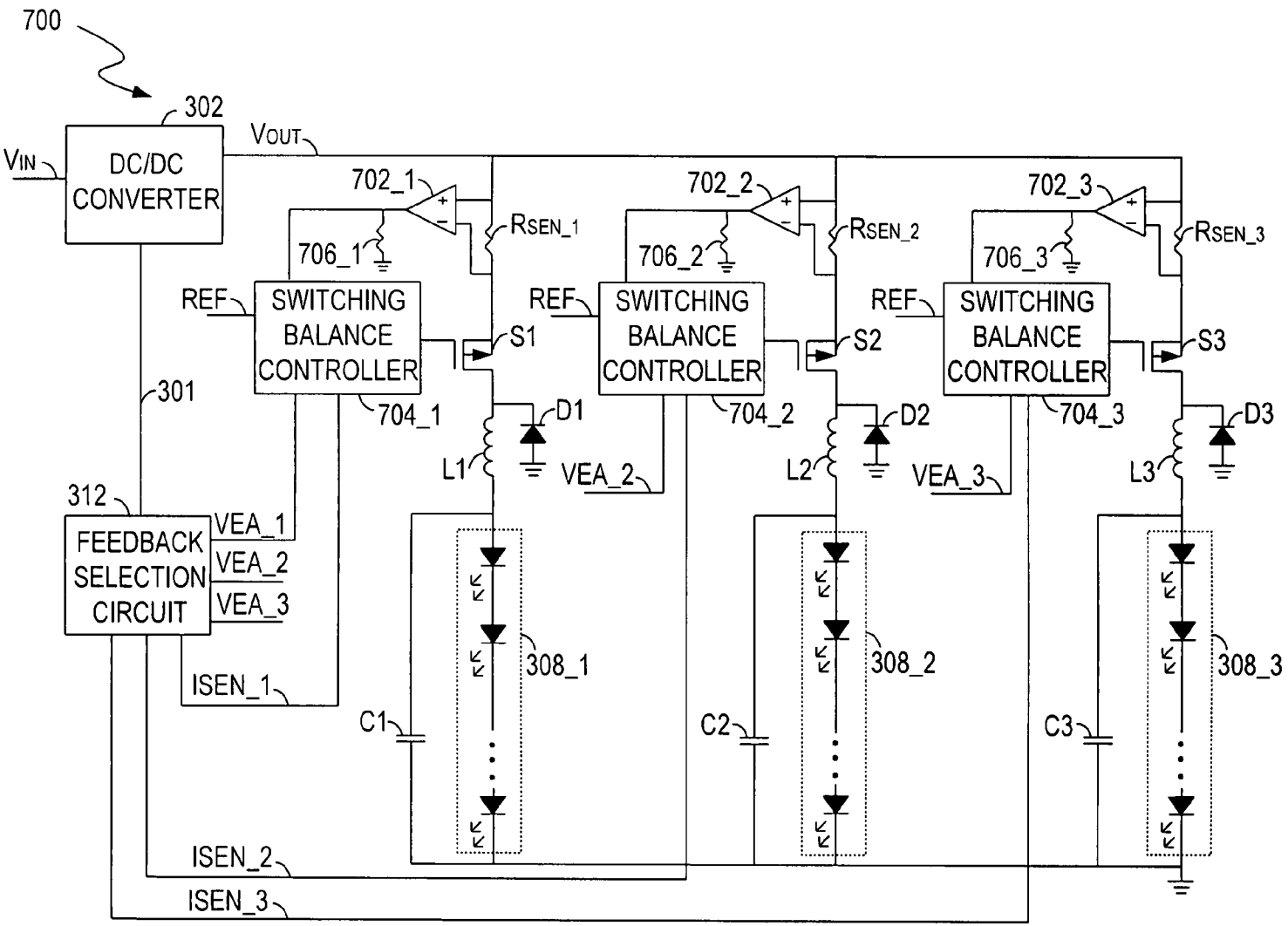
FIG. 7 shows a schematic diagram of an LED driving circuit, in accordance with one embodiment of the present invention.

FIG. 7 shows a schematic diagram of an LED driving circuit 700 with a common cathode connection, in accordance with one embodiment of the present invention. Elements labeled the same as in FIG. 4 have similar functions and will not be detailed described herein. In the example of FIG. 7, there are three LED strings 308_1, 308_2, and 308_3. However, any number of the LED strings can be included in the LED driving circuit 700.

Similar to the LED driving circuit 400 shown in FIG. 4, the LED driving circuit 700 utilizes a plurality of switching regulators (e.g., buck switching regulators) to adjust forward voltages of LED strings 308_1, 308_2, 308_3 based on a reference signal REF and a plurality of monitoring signals ISEN_1 ISEN_2, ISEN_3 which indicate LED currents of the LED strings 308_1, 308_2, and 308_3 respectively. The monitoring signals ISEN_1, ISEN_2, ISEN_3 can be obtained from a plurality of current sensors. In the example of FIG. 7, each current sensor includes a current sensing resistor Rsen_i (i=1, 2, 3), a differential amplifier 702_1 (i=1, 2, 3), and a resistor 706_i (i=1, 2, 3). The current sensing resistor Rsen_i is coupled to a corresponding LED string 308_i in series. The differential amplifier 702_i is coupled between the current sensing resistor Rsen_i and a switching balance controller 704_i. The resistor 706 is coupled between the differential amplifier 702_i and ground.

Each buck switching regulator includes a inductor Li(i=1, 2, 3), a diode Di (i=1, 2, 3), a capacitor Ci (i=1, 2, 3) and a switch Si (i=1, 2, 3) in one embodiment. The inductor Li is coupled in series with a corresponding LED string 308_i (i=1, 2, 3). The diode Di is coupled in parallel with the serially connected LED string and the inductor Li. The capacitor Ci is coupled in parallel with a corresponding LED string 308_i. The switch Si is coupled between the DC/DC converter 302 and the inductor Li. Each buck switching regulator is controlled by a pulse modulation signal, e.g., a pulse width modulation (PWM) signal, generated by a corresponding switching balance controller 704_i (i=1, 2, 3).

The LED driving circuit 700 also includes a DC/DC converter 302 for providing a regulated voltage, and a feedback selection circuit 312 for providing a feedback signal 301 to adjust the regulated voltage of the DC/DC converter, in order to satisfy a power need of an LED string having a maximum forward voltage.

During a first time period when the switch Si is turned on, an LED current flows through LED string 308_i to ground. The forward voltage of the LED string 308_i is proportional to a difference between the regulated voltage Vout and a voltage drop across a corresponding switching regulator, in one embodiment. During this first time period, DC/DC converter 302 powers the LED string 308_i and charges the inductor Li simultaneously by the regulated voltage Vout. During a second time period when the switch Si is turned off, an LED current flows through the inductor Li, the LED string 308_i, and the diode Di. During this second time period, the inductor Li discharges to power the LED string 308_i.

Figure 8:
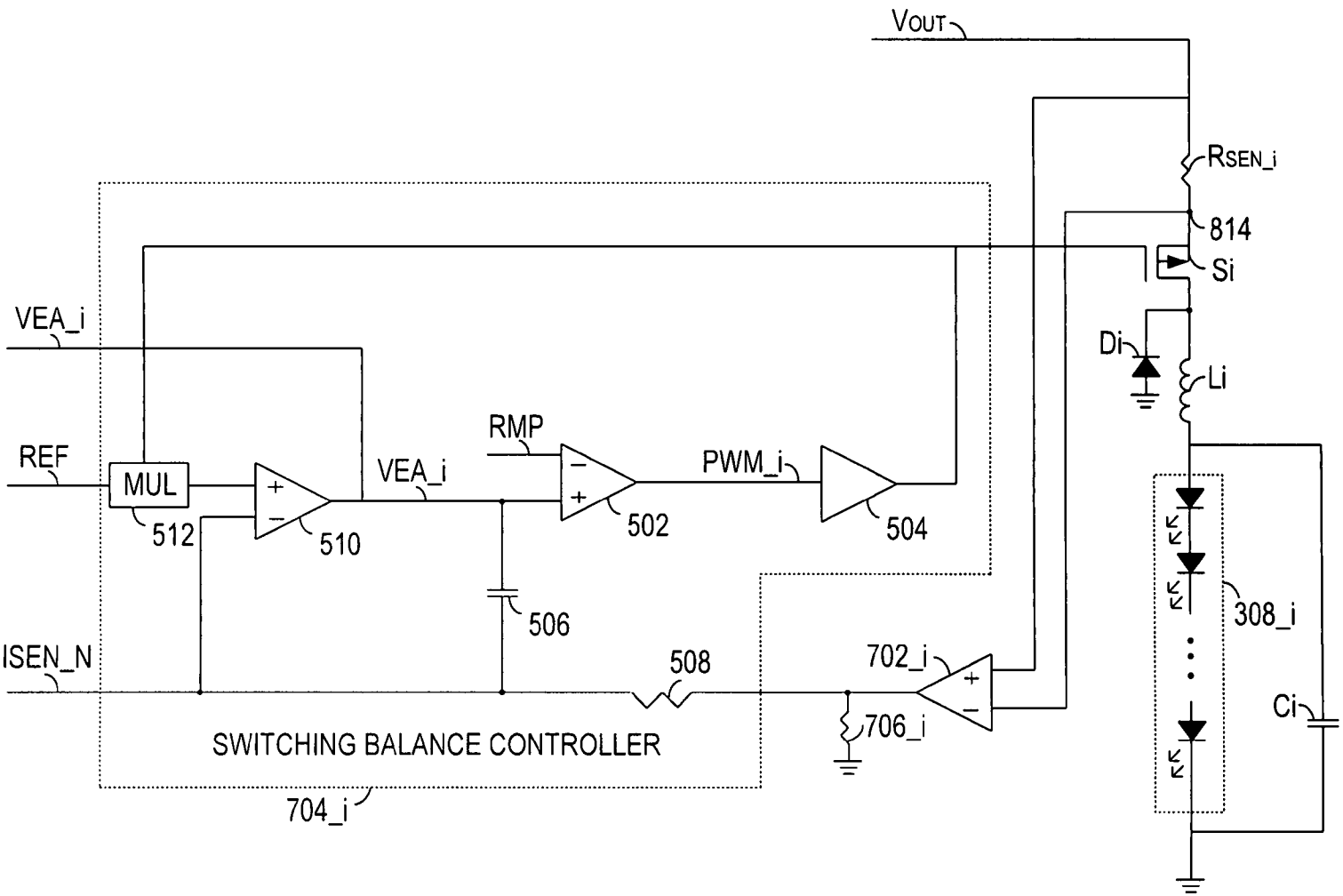
FIG. 8 shows an exemplary structure of a switching balance controller shown in FIG. 7 and the connection between the switching balance controller and a corresponding LED string, in accordance with one embodiment of the present invention.

FIG. 8 illustrates an exemplary structure of a switching balance controller 704_i (i=1, 2, 3) shown in FIG. 7 and the connection between the switching balance controller 704_i and a corresponding LED string 308_i. FIG. 8 is similar to FIG. 5 except that, for the LED driving circuit 700 shown in FIG. 7 with a common cathode connection, the differential amplifier 702_i detects the voltage drop across the current resistor Rsen_i. Through the resistor 706_i, a monitoring signal ISEN_i indicating an LED current of the LED strings 308_i can be provided. In one embodiment, resistor 706_i has the same resistance as the current sensing resistor Rsen_i.

Figure 9:
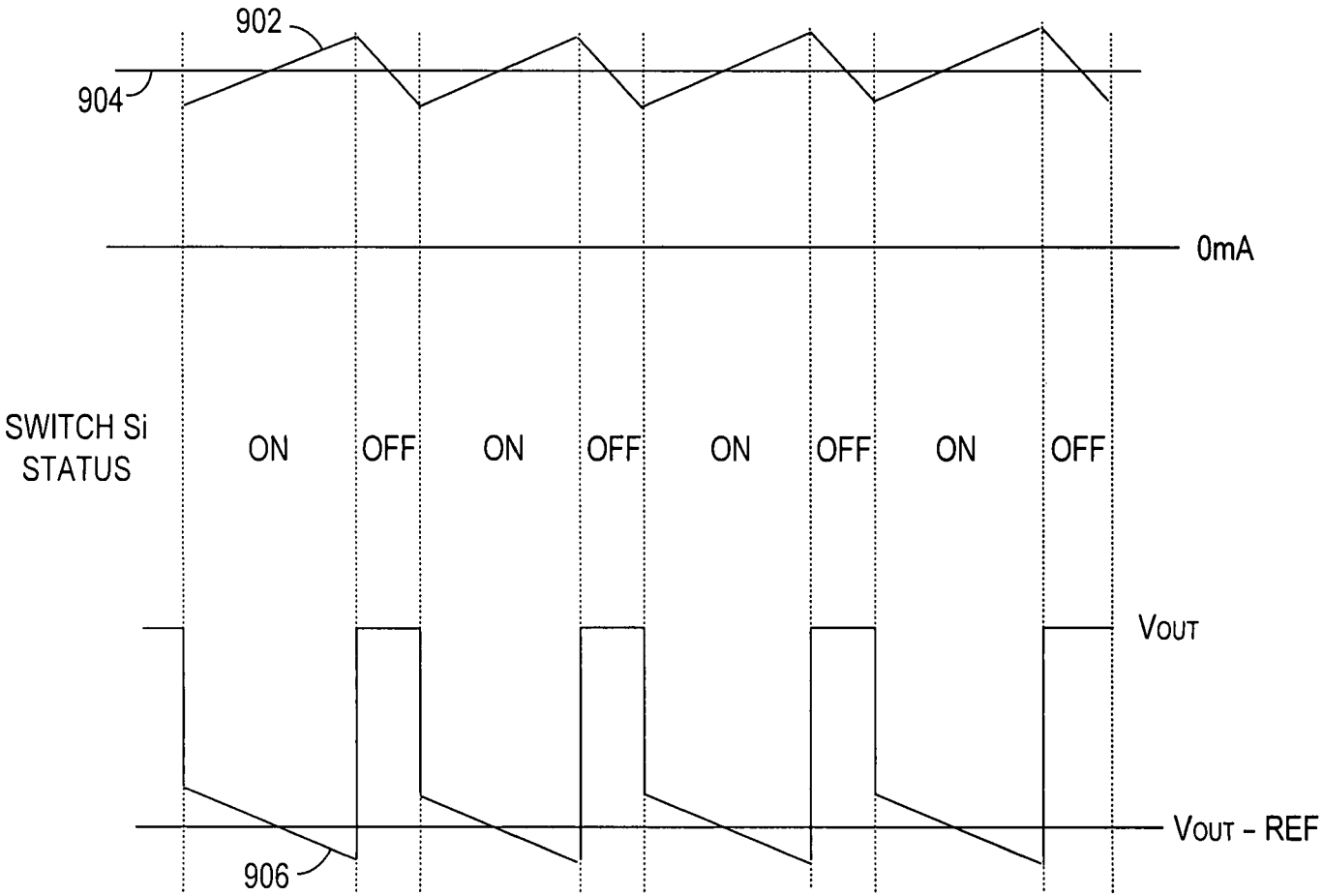
FIG. 9 illustrates the relationship among an LED current, an inductor current, and a voltage waveform at the current sensing resistor shown in FIG. 8, in accordance with one embodiment of the present invention.

FIG. 9 illustrates an exemplary relationship among an LED current 904 of LED string 308_i, an inductor current 902 of inductor Li, and a voltage waveform 906 at node 814 between Rsen_i and switch Si. FIG. 9 is described in combination with FIG. 7 and FIG. 8.

During the time period when the switch Si is turned on, the DC/DC converter 302 powers the LED string 308_i and charges the inductor Li by the regulated voltage Vout. When the switch Si is turned on by PWM_i, the inductor current 902 flows through the LED string 308_i to ground. The inductor current 902 increases when the switch Si is on, and the voltage waveform 906 at node 814 decreases simultaneously.

During the time period when the switch Si is turned off, the inductor Li discharges and the LED string 308_i is powered by the inductor Li. When the switch Si is turned off by PWM_i, the inductor current 902 flows through the inductor Li, the LED string 308_i, and the diode Di. The inductor current 902 decreases when the switch Si is off. Since there is no current flowing through the current sensing resistor Rsen_i, the voltage waveform 906 at node 814 rises to Vout.

In one embodiment, the capacitor Ci coupled in parallel with the LED string 308_i filters the inductor current 902 and yields a substantially constant LED current 904 whose level is an average level of the inductor current 902.

Accordingly, the LED current 904 of LED string 308_i can be adjusted towards the target current. The average voltage at node 814 when the switch Si is turned on is equal to the difference between Vout and the voltage of the reference signal REF, in one embodiment.

Figure 10:
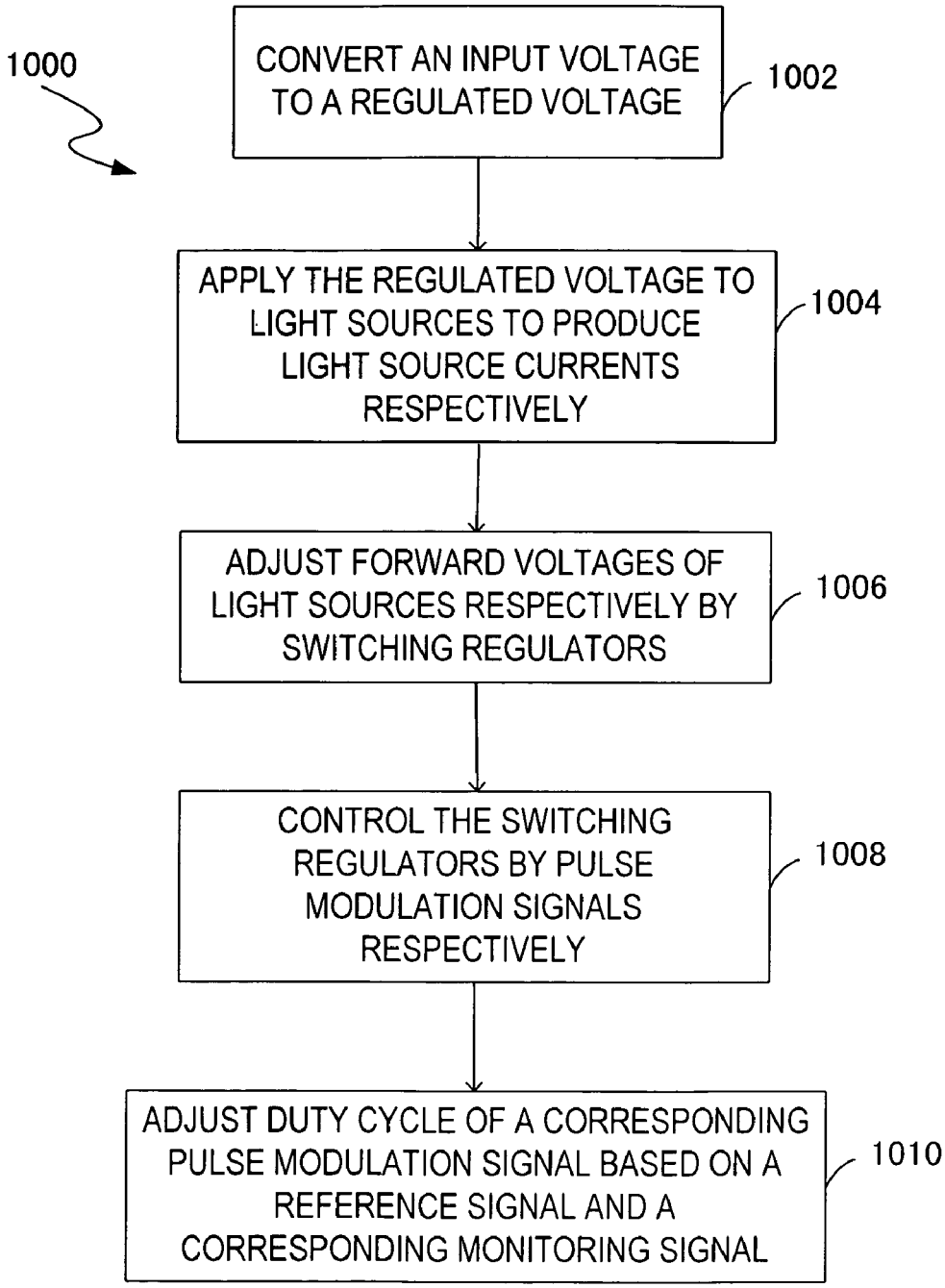
FIG. 10 shows a flowchart of a method for powering a plurality of light sources, in accordance with one embodiment of the present invention.

FIG. 10 illustrates a flowchart 1000 of a method for powering a plurality of light sources. Although specific steps are disclosed in FIG. 10, such steps are exemplary. That is, the present invention is well suited to performing various other steps or variations of the steps recited in FIG. 10. FIG. 10 is described in combination with FIG. 3 and FIG. 4.

In block 1002, an input voltage is converted to a regulated voltage by a power converter (e.g., a DC/DC converter 302).

In block 1004, the regulated voltage is applied to the plurality of light sources (e.g., the LED strings 308_1, 308_2, and 308_3) to produce a plurality of light source currents flowing through the light sources respectively.

In block 1006, a plurality of forward voltages of the plurality of light sources are adjusted by a plurality of switching regulators (e.g., a plurality of buck switching regulators 306_1, 306_2, and 306_3) respectively.

In block 1008, the plurality of switching regulators are controlled by a plurality of pulse modulation signals (e.g., PWM signals PWM_1, PWM_1, PWM_3) respectively. In one embodiment, a switch Si is controlled by a pulse modulation signal such that during a first time period when the switch Si is turned on, a corresponding light source is powered by the regulated voltage, and a corresponding inductor Li is charged by the regulated voltage. During a second time period when the switch Si is turned off, the inductor Li discharges, and the light source is powered by the inductor Li.

In block 1010, the duty cycle of a corresponding pulse modulation signal PWM_i is adjusted based on a reference signal REF and a corresponding monitoring signal ISEN_i. In one embodiment, the monitoring signal ISEN_i is generated by a current sensor 310_i, which indicates a light source current flowing through a corresponding light source.

Accordingly, embodiments in accordance with the present invention provide light source driving circuits that can adjust forward voltages of a plurality of light sources with a plurality of switching regulators respectively. Advantageously, as described above, light source currents flowing through the plurality of light sources can be adjusted to be substantially the same as a target current, and only one dedicated power converter may be required to power the plurality of light sources, in one embodiment. By using switching regulators instead of linear current regulators to adjust light source currents, the power efficiency of the system can be improved while heat generation is reduced. Furthermore, after determining a light source having a maximum forward voltage, the light source driving circuit can adjust the output of the power converter accordingly, so that the power needs of all the light sources can be satisfied.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A driving circuit for powering a plurality of light emitting diode (LED) strings, comprising:

a power converter operable for receiving an input voltage and for providing a regulated voltage to said plurality of LED strings;

a plurality of switching regulators coupled to said power converter and for adjusting a plurality of forward voltages of said plurality of LED strings respectively; and a plurality of switching balance controllers coupled to said plurality of switching regulators and for generating a plurality of pulse modulation signals to control said plurality of switching regulators respectively.

2. The driving circuit of claim 1, wherein each forward voltage of said plurality of forward voltages is proportional to a difference between said regulated voltage and a voltage drop across a corresponding switching regulator of said switching regulators.

3. The driving circuit of claim 1, wherein a plurality of LED currents flow through said plurality of LED strings according to said plurality of forward voltages respectively, and wherein said plurality of LED currents are substantially the same.

4. The driving circuit of claim 1, wherein each of said switching regulators comprises a buck switching regulator.

5. The driving circuit of claim 1, wherein each of said switching regulators comprises:

an inductor coupled in series with a corresponding LED string of said plurality of LED strings; and a switch coupled in series with said inductor and controlled by a corresponding pulse modulation signal of said plurality of pulse modulation signals, wherein said switch is only fully on or fully off.

6. The driving circuit of claim 1, further comprising:

a feedback selection circuit coupled between said power converter and said plurality of switching regulators and for determining an LED string having a maximum forward voltage from said plurality of LED strings, wherein said power converter is operable for adjusting said regulated voltage to satisfy a power need of said LED string having said maximum forward voltage.

7. The driving circuit of claim 6, further comprising:

a plurality of current sensors coupled to said plurality of LED strings and for generating a plurality of monitoring signals indicating a plurality of LED currents flowing through said plurality of LED strings respectively, wherein said feedback selection circuit receives said plurality of monitoring signals and determines said LED string having said maximum forward voltage according to said plurality of monitoring signals and a reference signal.

8. The driving circuit of claim 1, wherein each of said switching balance controllers receives a reference signal indicative of a target current and generates a pulse width modulation (PWM) signal to control a corresponding switching regulator of said switching regulators.

9. The driving circuit of claim 8, wherein each of said switching balance controllers comprises:

an error amplifier for generating an error signal by comparing a monitoring signal indicative of a LED current with said reference signal, wherein said PWM signal is generated based on said error signal to adjust said LED current towards said target current.

10. The driving circuit of claim 1, wherein each of said pulse modulation signals comprises a pulse width modulation (PWM) signal.

11. A display system comprising:

a liquid crystal display (LCD) panel;

a plurality of light emitting diode (LED) strings for illuminating said LCD panel;

a power converter operable for receiving an input voltage and for providing a regulated voltage to said plurality of LED strings;

a plurality of switching regulators coupled to said power converter and for adjusting a plurality of forward voltages of said plurality of LED strings respectively; and a plurality of switching balance controllers coupled to said plurality of switching regulators and for generating a plurality of pulse modulation signals to control said plurality of switching regulators respectively.

12. The display system of claim 11, wherein each forward voltage of said plurality of forward voltages is proportional to a difference between said regulated voltage and a voltage drop across a corresponding switching regulator of said switching regulators.

13. The display system of claim 11, wherein a plurality of LED currents flow through said plurality of LED strings according to said plurality of forward voltages respectively, and wherein said plurality of LED currents are substantially the same.

14. The display system of claim 11, wherein each of said switching regulators comprises a buck switching regulator.

15. The display system of claim 11, wherein each of said switching regulators comprises:

an inductor coupled in series with a corresponding LED string of said plurality of LED strings; and a switch coupled in series with said inductor and controlled by a corresponding pulse modulation signal of said plurality of pulse modulation signals, wherein said switch is only fully on or fully off.

16. The display system of claim 11, further comprising:

a feedback selection circuit coupled between said power converter and said plurality of switching regulators and for determining an LED string having a maximum forward voltage from said plurality of LED strings, wherein said power converter is operable for adjusting said regulated voltage to satisfy a power need of said LED string having said maximum forward voltage.

17. The display system of claim 16, further comprising:

a plurality of current sensors coupled to said plurality of LED strings and for generating a plurality of monitoring signals indicating a plurality of LED currents flowing through said plurality of LED strings respectively, wherein said feedback selection circuit receives said plurality of monitoring signals and determines said LED string having said maximum forward voltage according to said plurality of monitoring signals and a reference signal.

18. The display system of claim 11, wherein each of said switching balance controllers receives a reference signal indicative of a target current and generates a pulse width modulation (PWM) signal to control a corresponding switching regulator of said switching regulators.

19. The display system of claim 18, wherein each of said switching balance controllers comprises:

an error amplifier for generating an error signal by comparing a monitoring signal indicative of an LED current with said reference signal, wherein said PWM signal is generated based on said error signal to adjust said LED current towards said target current.

20. A method for powering a plurality of LED strings, comprising:

converting an input voltage to a regulated voltage;

applying said regulated voltage to said plurality of LED strings to produce a plurality of LED currents flowing through said LED strings respectively;

adjusting a plurality of forward voltages of said plurality of LED strings respectively by a plurality of switching regulators; and controlling said plurality of switching regulators by a plurality of pulse modulation signals respectively.

* * * * *